United States Patent [19]

Nakamura

[11] Patent Number: 4,612,655

[45] Date of Patent: Sep. 16, 1986

[54] DRIVING TIME ALARM FOR VEHICLE

[76] Inventor: Koichi Nakamura, 1-9-2, Shinyashiki, Kochi-Shi, Kochi-Ken, Japan

[21] Appl. No.: 597,468

[22] Filed: Apr. 5, 1984

[30] Foreign Application Priority Data

Apr. 18, 1983 [JP] Japan ..... 58-68191

[51] Int. Cl.[4] ..... G07C 5/02

[52] U.S. Cl. ..... 377/16; 377/20

[58] Field of Search ..... 377/15, 13, 20, 24, 377/44; 340/22, 56; 364/424; 180/272

[56] References Cited

U.S. PATENT DOCUMENTS

| | | | |
|---|---|---|---|
| 4,031,363 | 6/1977 | Freeman et al. | 377/20 |
| 4,338,512 | 7/1982 | Ludwig | 377/20 |
| 4,404,641 | 9/1983 | Bazarnik | 377/20 |
| 4,502,122 | 2/1985 | Yanagishima | 364/424 |

FOREIGN PATENT DOCUMENTS

| | | | |
|---|---|---|---|
| 2142574 | 2/1973 | Fed. Rep. of Germany | 180/272 |
| 34527 | 4/1981 | Japan | 180/272 |
| 79027 | 6/1981 | Japan | 180/272 |
| 114739 | 7/1982 | Japan | 340/56 |
| 167237 | 10/1983 | Japan | 340/56 |

*Primary Examiner*—Stanley D. Miller
*Assistant Examiner*—K. Ohralik
*Attorney, Agent, or Firm*—Martin Smolowitz

[57] ABSTRACT

A driving time alarm for a vehicle comprises a recess time setting counter for counting clock pulses during the time when the vehicle is not under running; and a driving time limit setting counter which counts during the time when said vehicle is under running and is reset by the count-up of said recess time setting counter, whereby an alarm is given when said driving time limit setting counter comes to a count-up state.

14 Claims, 6 Drawing Figures

DRIVING TIME ALARM FOR VEHICLE

BACKGROUND OF THE INVENTION

This invention relates to a driving time alarm for a vehicle, and more particularly it relates to a driving time alarm for preventing in advance a driving accident which may be caused by a driver's fatigue.

Generally, it is common knowledge that continuous and long driving of an automobile or the like causes from fatigue a lowering of the power of attention of the driver, deteriorates reflective faculties, or induces sleep, which might result in an increase in possibilities of the occurrence of driving accidents. In order to prevent such driving accidents, it is necessary for the driver to take a regular recess.

Conventional automobiles, however, have not been provided with any measures for estimating a driving time and giving notice of it to the driver. Therefore, the driver himself must be careful to take a recess at appropriate intervals.

SUMMARY OF THE INVENTION

The present invention has been made upon consideration of the above circumstances. It is therefore an object of the present invention to provide a driving time alarm for a vehicle in which upon a continuous driving beyond a time limit a notice is given to the driver in order to urge him to take a recess, and if the driver takes a short time recess which is insufficient for a required recess time, the short time recess is not taken into account and it is reckoned as a continuous driving, thereby making it possible to prevent in advance driving accidents which may be caused by driver fatigue.

In order to achieve the above object, the present invention provides a driving time alarm for a vehicle which comprises: an oscillator for generating clock pulses; a driving time limit setting counter which starts to count the clock pulses by detecting a start of driving; a recess time setting counter which starts to count the clock pulses by detecting a stop of driving; a means for giving an alarm by detecting that the counting operation of the driving time limit setting counter has been performed for a preset time (driving limit time); a means for terminating the alarm by detecting that the counting operation of the recess time setting counter has been performed for another preset time (recess time); and a means for making the driving time limit setting counter continue to count if a driving is resumed before the recess time setting counter completes the counting of its preset time.

DETAILED DESCRIPTION OF THE INVENTION

The embodiments of the invention will now be described with reference to the accompanying drawings.

Figure 1:
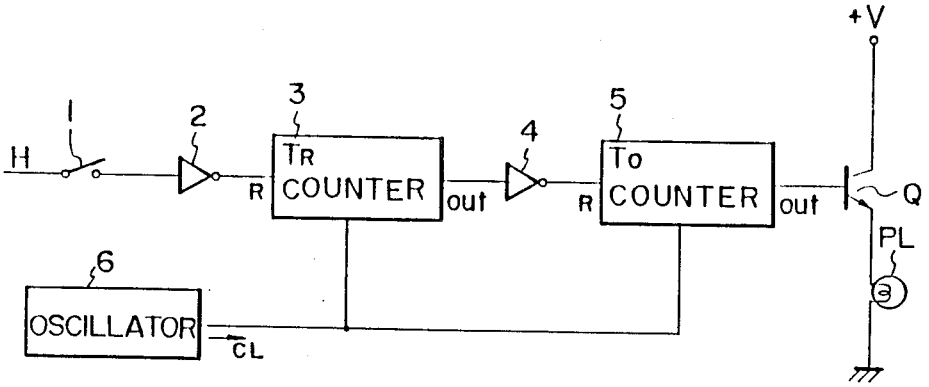
FIG. 1 is a schematic circuit diagram illustrating one embodiment of the driving time alarm for a vehicle according to the present invention.

FIG. 1 shows a circuit diagram of one embodiment of the present invention. A key 1 is activated ON when a driving of an automobile or the like is initiated, and is activated OFF when the driving is suspended. A signal delivered from the key 1 is applied through an inverter 2 to a reset terminal of a recess time setting counter 3 (hereinafter referred to as "$T_R$ counter"), and the output thereof is supplied through an inverter 4 to a reset terminal of a driving time limit setting counter 5 (hereinafter referred to as "$T_0$ counter"). Clock pulses CL generated from an oscillator 6 are supplied to both the $T_R$ counter 3 and $T_0$ counter 5. The output of the $T_0$ counter 5 is supplied to the base terminal of an NPN transistor Q (hereinafter referred to as "transistor"). The transistor Q is provided with a power source (+V) at its collector terminal, and the emitter terminal is grounded through a pilot lamp PL.

Both $T_R$ counter 3 and $T_0$ counter 5 each comprise an incremental counter which has three terminals including an input terminal, an output terminal, and a reset terminal, and operate as follows: upon receipt of a high level (hereinafter referred to as "H") at the reset terminal, the counter starts to count up the clock pulses CL applied to the input terminal, while upon receipt of a low level (hereinafter referred to as "L") at the reset terminal, the counter terminates to count the clock pulse CL and clears the contents thereof. When the contents of the counter reaches a preset value, the output signal at the output terminal changes from "L" to "H", and retains its "H" state until the reset terminal receives "L". Illustratively, a preset time (or driving limit time) for the $T_0$ counter 5 may be about 120 minutes, and a preset time (or recess time) for the $T_R$ counter 3 may be about 10 minutes.

Figure 2:
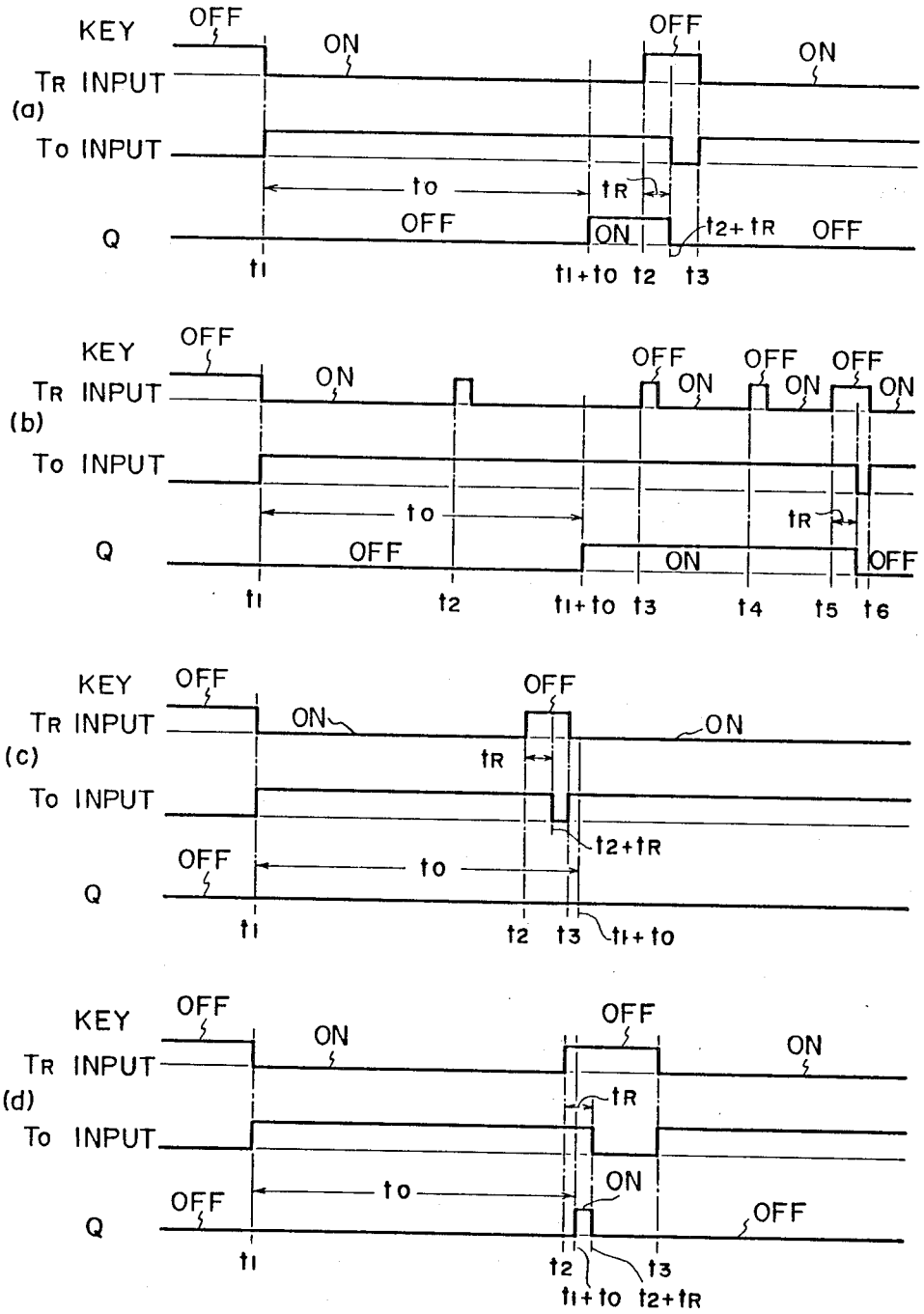
FIG. 2 is a timing chart for explaining the operation of the embodiment shown in FIG. 1.

FIG. 2 is a timing chart for illustrating the operation of the embodiment shown in FIG. 1. In the figure, a waveform represented by a legend "KEY" indicates an ON.OFF state of the key 1, a waveform represented by a legend "$T_R$ input" indicates an input level of the $T_R$ counter 3 (i.e., an output level of the inverter 2), a waveform represented by a legend "$T_0$ input" indicates an input level of the $T_0$ counter 5 (i.e., an output level of the inverter 4), and a waveform represented by a legend "Q" indicates an ON.OFF state of the transistor Q (i.e., an output level of the $T_0$ counter 5). In FIGS. 2(*a*) through 2(*d*), the initial conditions are held at a state representative of the completion of the counting operation of the $T_R$ counter 3.

FIG. 2(*a*) shows a timing chart of the operation where a driving has been performed (the key 1 has been turned ON) beyond the preset time (driving limit time), and thereafter the driving is being suspended (the key 1 is being turned OFF) beyond the preset time (recess time).

Upon turning the key 1 ON at a time instant $t_1$, the input for the inverter 2 is rendered "H", so that the reset input for the $T_R$ counter 3 is supplied with "L" which has been inverted by the inverter 2. Then, the contents of the $T_R$ counter 3 is cleared to change the output level thereof from "H" to "L". Therefore, the level of the reset input to the To counter 5 changes from "L" to "H", so that the To counter 5 also changes from "L" to "H", so that the $T_0$ counter 5 starts to count the clock pulse CL.

At a time instant $t_1+t_0$ ($t_0$ is a driving limit time), the count value of the $T_0$ counter 5 reaches a preset value, and the output level thereof changes from "L" to "H", the latter "H" being supplied to the base of the transistor Q. As a result, the transistor Q is rendered ON to illuminate the pilot lamp PL. It is noted that upon driving beyond the driving limit time, an alarm is given to the driver.

When the key 1 is turned OFF at a time instant $t_2$, the $T_R$ counter 3 is supplied at its reset input with "H" which has been inverted by the inverter 2. Therefore, the counting operation for the clock pulse CL by the $T_R$ counter 3 starts. Since the output level of the $T_R$ counter 3 is maintained "L", so that the output of the inverter 4 is maintained "H" until the count value of the $T_R$ counter 3 reaches the preset value the counting operation of the $T_0$ counter 5 is disabled, with the output level of the $T_0$ counter 5 being held at "H".

The count value of the $T_R$ counter 3 reaches a preset value at a time instant $t_2+t_R$ ($t_R$ is a recess time), so that the output level thereof changes from "L" to "H", which "H" in turn is applied to the reset input of the $T_0$ counter 5 following the inversion by the inverter 4. Therefore, the contents of the $T_0$ counter 5 is cleared to change its output level to "L" so that the transistor Q is rendered OFF. Thus, the driver is notified from the turning off of the pilot lamp PL that he has taken a sufficient recess.

When the key 1 is again turned ON at a time instant $t_3$, the above operation is repeated.

FIG. 2(*b*) shows a timing chart of the operation where a driving beyond the driving limit time has been performed, and thereafter a recess within the preset time is taken twice and a recess beyond the preset time is taken.

When the key 1 is turned ON at a time instant $t_1$, the $T_0$ counter 5 starts to count as is similar to that shown in FIG. 2(*a*).

When the key 1 is turned OFF at a time instant $t_2$, the input level of the $T_R$ counter 3 is rendered "H" to initiate the counting of the clock pulse CL. However, since the key 1 is again turned ON before the count value reaches the preset value, the output level of the $T_R$ counter 3 is maintained "L". Thus, the counter 5 continues its counting regardless of the recess which has been taken unsatisfactorily, until the driving limit time comes. Therefore, in the case of insufficient recess, it is assumed that no recess has been taken and the driving is continuously going on.

At a time instant $t_1+t_0$, the $T_0$ counter 5 counts up the clock pulses corresponding to the driving limit time $t_0$ including the insufficient recess times. Then, the output level of the $T_0$ counter 5 is rendered "H" to turn on the transistor Q, thereby illuminating the pilot lamp PL. After this time instant, the counting operation of the $T_0$ counter 5 is terminated, with the output level thereof retaining "H".

At time instants $t_3$, $t_4$ when the key 1 is turned OFF, the $T_R$ counter starts to count. However, since the reset input of the $T_0$ counter 5 is maintained "H" until the count value of the $T_R$ counter 3 reaches the preset value to change the output thereof from "L" to "H", the pilot lamp PL continues to illuminate.

It can be understood that the pilot lamp PL continues to illuminate unless the driver takes, after activating the key 1 OFF, a successive recess longer than the recess time preset by the counter 3. If it is an insufficient recess, the pilot lamp PL is not turned off, which notifies and hence urges the driver to take a further recess. Thus, the pilot lamp PL has two functions, one alarming an over-driving time, and the other alarming an insufficient recess time.

Upon taking a recess from a time instant $t_5$ when the key 1 is turned OFF to a time instant $t_6$ (that is, the recess is over a time period $t_R$), the count value of the $T_R$ counter 3 reaches the preset value to make the output level thereof turn to "L". Consequently, the $T_0$ counter 5 is cleared, the output level thereof is rendered "L", and the transistor Q is turned OFF. Thus, if a recess is taken beyond the preset time, the pilot lamp PL extinguishes for the first time.

FIG. 2(*c*) is a timing chart illustrating the operation where a recess beyond the preset time is taken before the driving time exceeds the driving limit time.

When the key 1 is turned ON at a time instant $t_1$, the $T_0$ counter 5 starts to count as is similar to that described with FIG. 2(*a*).

When the key 1 is turned OFF at a time instant $t_2$, the input level of the $T_R$ counter 3 is rendered "H" thereby to start the counting of the clock pulses CL. In this case, the counting operation of the $T_0$ counter 5 is concurrently performed.

At a time instant $t_2+t_R$, the count value of the $T_R$ counter 3 reaches the preset value, so that the output level of the $T_R$ counter 3 changes from "L" to "H". Accordingly, since the reset input of the $T_0$ counter 5 changes from "H" to "L", the counting of the clock pulse CL by the $T_0$ counter 5 is terminated and the contents thereof is cleared.

When the key 1 is turned ON at a time instant $t_3$, the counting operation of the $T_0$ counter 5 starts again. Thus, the circuit returns to its initial condition in the case where a recess beyond the preset time is taken while the driving is being performed within the driving limit time.

FIG. 2(*d*) is a timing chart illustrating the operation where the key 1 is turned OFF before the lapse of the driving limit time commences from the time instant when the key 1 is turned ON, and the driving limit time passes before the lapse of the preset time commences from the time instant when the key 1 is turned OFF.

At a time instant $t_1$ when the key 1 is turned ON, the $T_0$ counter 5 starts to count as is similar to that described with FIG. 2(*a*).

When the key 1 is thereafter turned OFF at a time instant $t_2$, the counting operations by both $T_R$ and $T_0$ counters 3 and 5 are performed concurrently as described with FIG. 2(*c*).

At a time instant $t_1+t_0$, in spite of the recess state (i.e., the key 1 is of OFF state), the count value of the $T_0$ counter 5 reaches the preset count value. Therefore, the output of the $T_0$ counter 5 is rendered "H" level thereby to turn ON the transistor Q, which results in energizing the pilot lamp PL.

At a time instant $t_2+t_R$, the count value of the $T_R$ counter 3 reaches the preset value, so the output level thereof changes to "H". Hence, the $T_0$ counter 5 is cleared, the transistor Q is turned OFF, and the pilot lamp PL extinguishes. Thus, the circuit returns to its initial condition.

Figure 4:
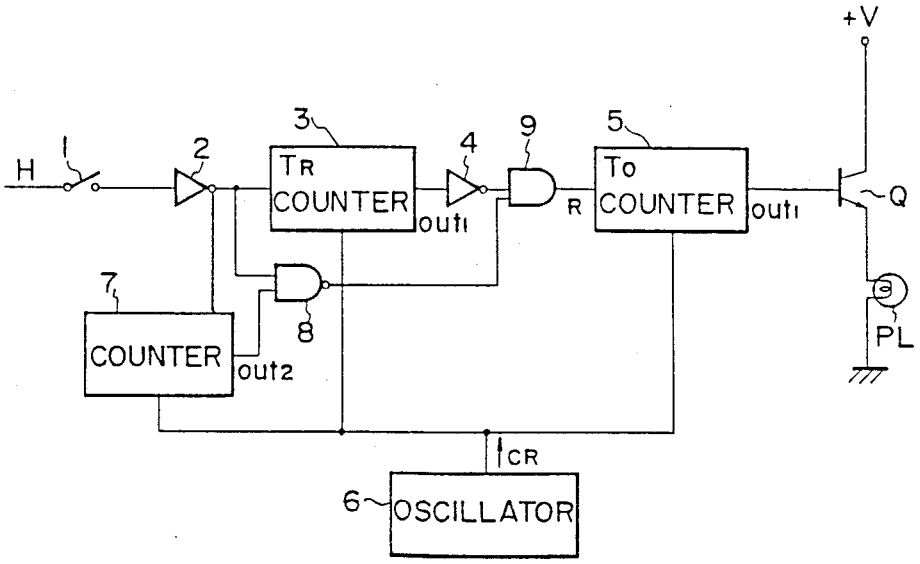
FIG. 4 is a schematic circuit diagram in which a circuit for eliminating a possible error at the time of power-on in the embodiment of FIG. 1 is added.

FIG. 4 shows a circuit diagram in which the embodiment shown in FIG. 1 is so modified as to obviate the count errors which may be caused at the time when the circuit is powered on. In the figure, identical reference numbers have been used to designate corresponding constitutional elements of FIG. 1. A counter 7 is provided for counting the clock pulse CL generated from the oscillator 6, and the output of the counter 7 is supplied to one input of a NAND circuit 8. Unlike the outputs of the $T_R$ and $T_0$ counters 3 and 5, the output of the counter 7 takes "H" at its initial condition, and changes to "L" when the count value thereof reaches the preset value (same as the preset value of the $T_R$ counter 3). When the driving key switch 1 is ON state, a reset signal such as the output of the inverter 2 is applied to a reset terminal (not shown) of counter 7 so that the count value thereof is cleared. To the other input of the NAND circuit 8, the output of the inverter 2 is supplied. The output of the NAND circuit 8 is supplied to one input of an AND circuit 9, while the output of the inverter 4 is supplied to the other input of the AND circuit 9. The output of the AND circuit 9 is supplied to the reset input of the $T_0$ counter 5.

Figure 3:
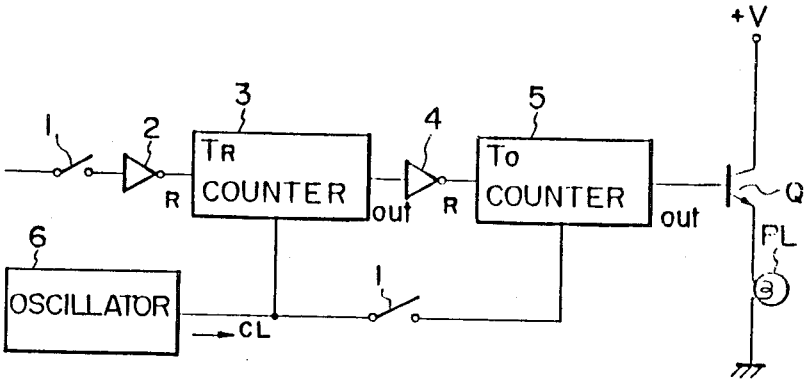
FIG. 3 is a schematic circuit diagram in which a modified input circuit for a $T_0$ counter in the circuit of FIG. 1 is employed.

With such a circuit configuration, it is possible to adjust the deviation of the count value of the $T_0$ counter 5, which deviation may occur when the power is supplied to the circuit. In the circuit shown in FIG. 1, if the key 1 is maintained OFF at the time when the power is supplied to the alarm, both reset inputs of the $T_R$ and $T_0$ counters 3 and 5 are held "H". Therefore, both counters 3 and 5 concurrently start to count the clock pulse CL. In other words, the $T_0$ counter 5 starts to count even under the condition of OFF state of the key 1. In order to meet the above situation, one measure can be taken as is shown in FIG. 3, in which another key 10 is provided in the midway of the clock signal line to the $T_0$ counter 5 so that the clock pulse signal CL from the oscillator 6 is not applied to the $T_0$ counter 5 under the OFF state of the key 10. An alternative measure can also be taken as is shown in FIG. 4. In the circuit shown in FIG. 4, the output of the counter 7 is maintained "H" until the count value of the $T_R$ counter 3 reaches the preset value. Thus, improper counting operation by the $T_0$ counter 5 during the time when the $T_R$ counter 3 is counting can be avoided.

Figure 5:
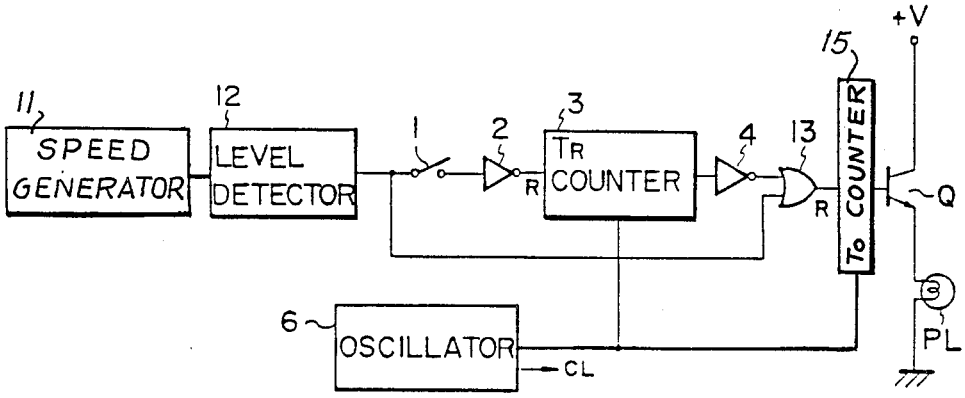
FIG. 5 is a schematic circuit diagram in which a driving speed is used for an additional condition in judging whether the vehicle is considered as running or not.

FIG. 5 shows a further embodiment according to the present invention. In this embodiment, input conditions for resetting the $T_R$ counter 3 are arranged to be determined, in addition to the condition that the key 1 is ON, by the condition that the vehicle is running. More particularly, a speed generator 11 generates a speed signal corresponding to the revolution rate of the wheels of the vehicle. The speed signal is supplied to a level detector 12 which detects whether the vehicle is running with a speed faster than a preset speed or not. The detected signal which takes "L" when the vehicle stops is supplied to one end of the keys 1 of FIGS. 1 and 3. The detected signal is further supplied through the inverter 2 to the reset terminal R of the $T_R$ counter 3. With this circuit configuration, it can be understood that when the vehicle stops, with the key switch 1 being closed, the level detector 12 delivers "L" output, which causes the $T_R$ counter 3 to count the lock pulse CL. Further, when the vehicle starts to run, the output of the level detector 12 changes to "H" which is eventually supplied to the reset terminal R of the $T_0$ counter 5, resulting in the start of the counting of the clock pulse CL by the $T_0$ counter 5.

The circuit of FIG. 5 is capable of measuring the recess time when the driver is taking a reset while the vehicle stops and the key is kept ON.

Figure 6:
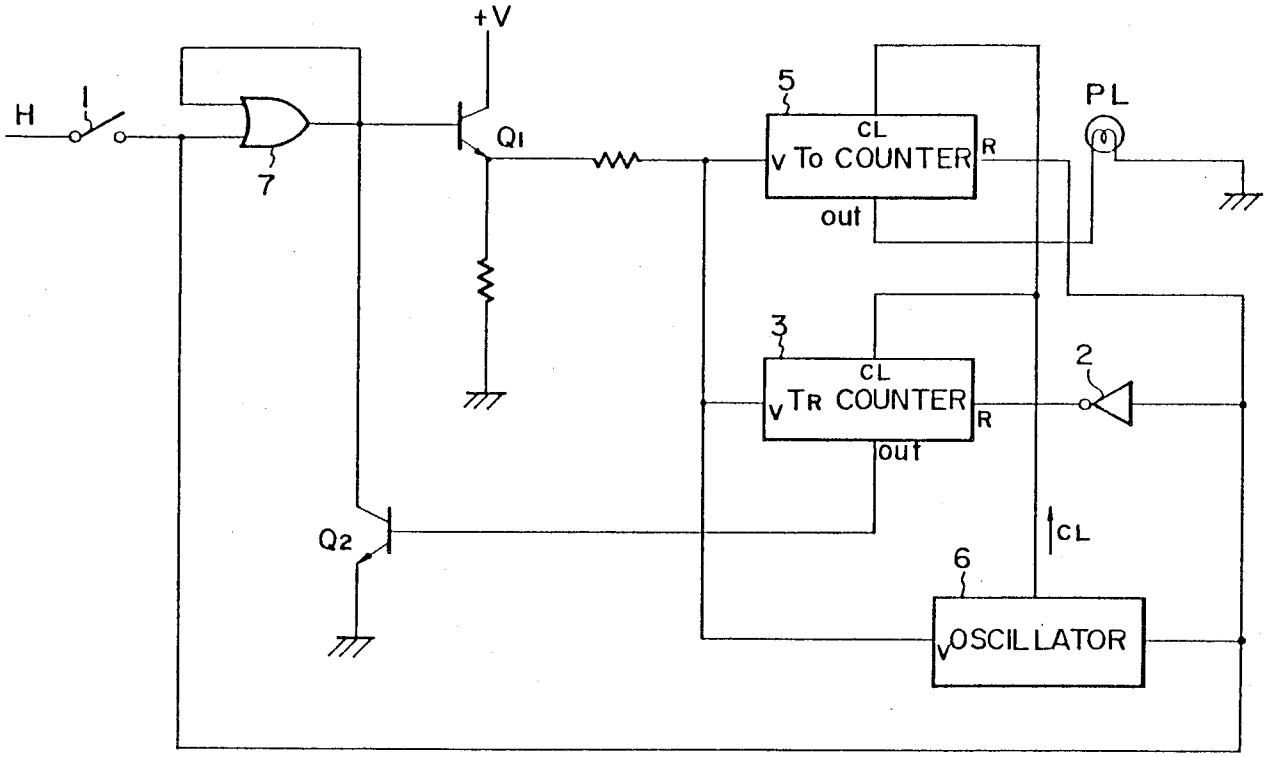
FIG. 6 is a schematic circuit diagram in which a power feeding line to an oscillator and counters is controllable.

FIG. 6 shows a circuit diagram of a still further embodiment of the present invention, which is capable of reducing the power consumption by cutting off the power line to the apparatus while it is not for use.

In this embodiment, the output of the OR circuit 14 becomes "H" upon turning the key 1 ON, and then remains unchanged. Then, the transistor $Q_1$ turns ON and supplies power current to the $T_0$ counter 5, the $T_R$ counter 3 and the oscillator 6 therethrough, so that the oscillator 6 applies clock pulses CL to the $T_0$ counter 5 and the $T_R$ counter 3. The $T_R$ counter 3 is, at first, not rendered on counting condition since the $T_R$ counter 3 has been applied the reset signal from the key 1 through the inverter 2, and only the $T_0$ counter 5 counts the clock pulses CL toward the predetermined value at which the $T_0$ counter 5 lights a lamp PL.

Thereafter, the reset signal to the $T_R$ counter 3 disappears upon turning the key 1 OFF, and the reset signal is applied to the $T_0$ counter 5, enabling the $T_R$ counter 3 to count the clock pulses CL. Consequently, when the recess time has elapsed by a predetermined amount, for example ten minutes, the transistor $Q_2$ turns ON due to the output of the $T_R$ counter 3 to render the output of OR circuit 14 "L" and to turn the transistor $Q_1$ OFF thereby to interrupt a power supply line to the $T_0$ counter 5, $T_R$ counter 3 and the oscillator 6.

Accordingly, the power consumption of the $T_0$ counter 5, the $T_R$ counter 3 and the oscillator 6 can be minimized as long as the driver takes a rest properly.

As described above, the present invention is so constructed as to measure the driving and recess times by counting the clock pulse, and to turn on or off the pilot lamp PL in accordance with the counted value. Therefore, the driver can easily recognize from the illumination of the pilot lamp PL that he has been driving the vehicle beyond the driving time limit, and also he can easily recognize from the continuation of the pilot lamp illumination that he has not yet taken a sufficient recess. Therefore, driving accidents can be prevented in advance which may be caused from a lowering of the power of attention, deterioration of reflective faculties, or sleepiness of the driver. Moreover, since the insufficient recess is not considered as a rest, prevention of accidents is improved more effectively.

Specifically, since the circuit according to the present invention is constructed with an oscillator for generating clock pulses, counters (each comprising inverters, flip-flops, binary counters and the like) for counting the clock pulse and the like, it is light in weight, low in cost, and high in reliability.

In the above embodiments, although the pilot lamp PL are used for notifying the driver of the limit time, it is also possible to employ other alarm means such as a buzzer or the like. Further, it is apparent that the present invention can be applied to other subjects than vehicles.

What is claimed is:

1. A driving time alarm for a vehicle, comprising:

an oscillator for generating clock pulses; a driving time limit setting counter connected to said oscillator, which driving time counter starts to count said clock pulses by detecting a start of driving;

a recess time setting counter connected to said oscillator, which recess time counter starts to count said clock pulses by detecting a stop of driving;

means for generating an alarm by detecting that the count value of said driving time limit setting counter reaches a first preset value after the start of counting operation thereof;

means for stopping the operation of said alarm generating means by detecting that the count value of said recess time setting counter reaches a second preset value after the start of counting operation thereof; and means for making said driving time limit setting counter continue to count if the driving of said vehicle starts before the count value of said recess time setting counter reaches said second preset value after the start of counting operation thereof.

2. A driving time alarm for a vehicle as set forth in claim 1, wherein said recess time setting counter is adapted to count said clock pulses during the time when a driving key switch of said vehicle is maintained off.

3. A driving time alarm for a vehicle as set forth in claim 1, wherein said driving time limit setting counter is adapted to receive said clock pulses from said oscillator through a driving key switch of said vehicle.

4. A driving time alarm for a vehicle as set forth in claim 2, further comprising means for counting said clock pulses from said oscillator and for stopping the counting operation of said driving time limit setting counter until the count value of said counting means reaches said second preset value, whereby in the case where said driving key switch is off at the time of turning-on of a power source of said alarm, said driving time limit setting counter is relieved from counting errors.

5. A driving time alarm for a vehicle as set forth in claim 1, further comprising means for detecting in accordance with a running speed of said vehicle whether said vehicle is stopping or not, whereby said recess setting counter is adapted to count said clock pulses on condition that said key switch is one and that said vehicle is detected in accordance with said running speed of said vehicle to be at a stop.

6. A driving time alarm for a vehicle as set forth in claim 1, further comprising means for controlling power supply to be ON while keeping energized in accordance with the commencement of driving said vehicle, and controlling the power supply to be OFF when terminating said energizing in accordance with the stopping of said vehicle, whereby each of said counters and said oscillator are fed from said power supply when said power supply controlling means in ON.

7. A driving time alarm for a vehicle as set forth in claim 1, including a power supply connected to a transistor means for controlling the power supply to be off when a predetermined count of clock pulses by the recess time setting counter has occurred.

8. A driving time alarm for a vehicle, comprising:

an oscillator for generating clock pulses;

a driving time limit setting counter connected to said oscillator, which driving time counter starts to count said clock pulses as said vehicle starts to run, wherein said driving time limit counter is adapted to receive said clock pulses from said oscillator through a driving key switch of said vehicle;

a recess time setting counter connected to said oscillator, which recess time counter starts to count said clock pulses as said vehicle stops, wherein said recess setting counter is adapted to count said clock pulses during the time when the driving key switch of said vehicle is maintained off;

means for generating an alarm by detecting that the count value of said driving time limit setting counter reaches a first preset value after the start of counting operation thereof;

means for stopping the operation of said alarm generating means by detecting that the count value of said recess time setting counter reaches a second preset value after the start of counting operation thereof; and means for making said driving time limit setting counter continue to count if the driving of said vehicle starts before the count value of said recess time setting counter reaches said second preset value after the start of counting operation thereof.

9. A driving time alarm for a vehicle, comprising:

an oscillator for generating clock pulses;

a driving time limit setting counter connected to said oscillator, which driving time counter has an input terminal, an output terminal and a reset terminal and starts to count said clock pulses from said input terminal when no signal is applied to said reset terminal, and outputs an alarm signal from said output terminal when a count value thereof reaches a first preset value;

a recess time setting counter connected to said oscillator, which recess time counter has an input terminal, an output terminal and a reset terminal and starts to count said clock pulses from said input terminal when no signal is applied to said reset terminal, and outputs a reset signal from said output terminal to said reset terminal of said driving time limit setting counter when a count value thereof reaches a second preset value;

means for generating an alarm when said driving time limit setting counter outputs said alarm signal; and means for applying a signal to said reset terminal of said driving time limit setting counter as said vehicle runs.

10. A driving time alarm for a vehicle as set forth in claim 9, wherein said alarm generating means is the output of said driving time counter connected to a transistor and a pilot lamp.

11. A driving time alarm for a vehicle as set forth in claim 9, wherein said driving time limit setting counter is arranged to receive said clock pulses from said oscillator through a driving key switch of said vehicle.

12. A driving time alarm for a vehicle as set forth in claim 9, further comprising a third counter which counts said clock pulses from said oscillator and outputs a signal when the count value thereof reaches a preset value which is the same as said second preset value; and means for stopping the counting of said driving time limit setting counter until the count value of said third counter reaches said second preset value.

13. A driving time alarm for a vehicle as set forth in claim 9, further comprising means for detecting in accordance with a running speed of said vehicle whether said vehicle is stopping or not, whereby said recess setting counter is adapted to count said clock pulses on condition that a driving key switch for the vehicle is on and that said vehicle is detected in accordance with said running speed of said vehicle to be at a stop.

14. A driving time alarm for a vehicle as set forth in claim 9, further comprising means for controlling power supply to be ON while keeping energized in accordance with the commencement of running said vehicle and to be OFF when terminating said energizing in accordance with the stopping of said vehicle, whereby each of said counters and said oscillator are fed from said power supply when said power supply controlling means is ON.

* * * * *